US005566454A

United States Patent [19]

Eisenbraun

[11] Patent Number: 5,566,454

[45] Date of Patent: Oct. 22, 1996

[54] POWER CUTTING SHEARS

[75] Inventor: Kenneth D. Eisenbraun, Birmingham, Mich.

[73] Assignee: United Industrial Trading Corp., Troy, Mich.

[21] Appl. No.: 523,291

[22] Filed: Sep. 5, 1995

[51] Int. Cl.[6] ..... B26B 15/00

[52] U.S. Cl. ..... 30/228; 30/258

[58] Field of Search ..... 30/228, 229, 258, 30/279.2, 287, 299, 245

[56] References Cited

U.S. PATENT DOCUMENTS

| | | | |
|---|---|---|---|
| 1,345,882 | 7/1920 | Repass | 30/229 |
| 2,093,987 | 9/1937 | Wallace | 30/258 |
| 3,025,599 | 3/1962 | Sauers et al. | 30/228 |
| 3,362,071 | 1/1968 | Schmidt | 30/258 |
| 3,631,596 | 1/1972 | Glaus | 30/228 |
| 3,808,682 | 5/1974 | Sumida | 30/228 |
| 4,779,343 | 10/1988 | Hacikyan | 30/258 |

*Primary Examiner*—Hwei-Siu Payer

*Attorney, Agent, or Firm*—Gifford, Krass, Groh, Sprinkle, Patmore, Anderson & Citkowski, P.C.

[57] ABSTRACT

An electrically powered portable cutting shear is disclosed for cutting a narrow elongated strip from a sheet of material. The cutting shear has a bifurcated cutting end with two spaced apart sides and a motorized cutting arm which pivots up and down between the respective sides of the cutting end. The cutting end has a first pair of removable spaced apart cutting edges mounted thereon while the cutting arm supports a second pair of removable cutting edges which are operatively received between the cutting edges supported on the cutting end and adapted to cut two edges of a narrow strip of material. A spacer is provided between the cutting arm blades and operates to dislodge the cut strip during the cutting process so that the strip does not interfere with the cutting action of the blades.

7 Claims, 2 Drawing Sheets

POWER CUTTING SHEARS

BACKGROUND OF THE INVENTION

1. Field of the Invention

The present invention relates to a cutting tool and more particularly to a hand held electrically powered cutting shear adapted to cut a strip from a sheet material.

2. Description of the Related Art

Skilled craftsman use a variety of cutting shears to cut patterns for stenciling. In the stained glass art, for example, a pattern must be cut which is representative of the stained glass artwork to be produced. The pattern must provide for a space to receive soldering which ultimately holds together the various pieces of glass. Therefore, it is desirable to have a cutting shear which can be used to trace a pattern and which cuts two substantially parallel spaced slits to separate a narrow strip from the pattern of a width required for soldering the glass pieces together.

Manual cutting shears operative to cut such a strip are known in the art as disclosed in U.S. Pat. No. 4,779,343. Manual shears have several disadvantages in that they are tedious to use over long periods of time and require more time for cutting a pattern. Moreover, manual shears are more costly to manufacture since a relatively lengthy blade must be made. Finally, they are costly to maintain, since they require sharpening.

SUMMARY OF THE INVENTION

The present invention overcomes the abovementioned disadvantages by providing a power operated cutting shear having a bifurcated cutting end with two sides which are spaced apart and a motorized cutting arm which pivots up and down between the respective sides of the cutting end. The cutting end has a first pair of removable, spaced apart cutting blades mounted thereon while the cutting arm supports a second pair of removable cutting blades which are mounted between the cutting blades supported on the cutting end.

When a piece of material to be cut is passed between the cutting end and the cutting arm, the cutting blades of the arm engage thereby severing the material into two substantially parallel slits which form two edges of a strip. Disposed between the second pair of cutting arm blades is a means for dislodging the cut strip from the material during the cutting process so that a uniform strip is cut and subsequently removed from the path of the blades in a non-interfering manner.

BRIEF DESCRIPTION OF THE DRAWINGS

Reference will now be made to the attached drawings, wherein like reference numerals refer to like parts throughout the several views, and in which.

DESCRIPTION OF THE PREFERRED EMBODIMENTS

Figure 1:
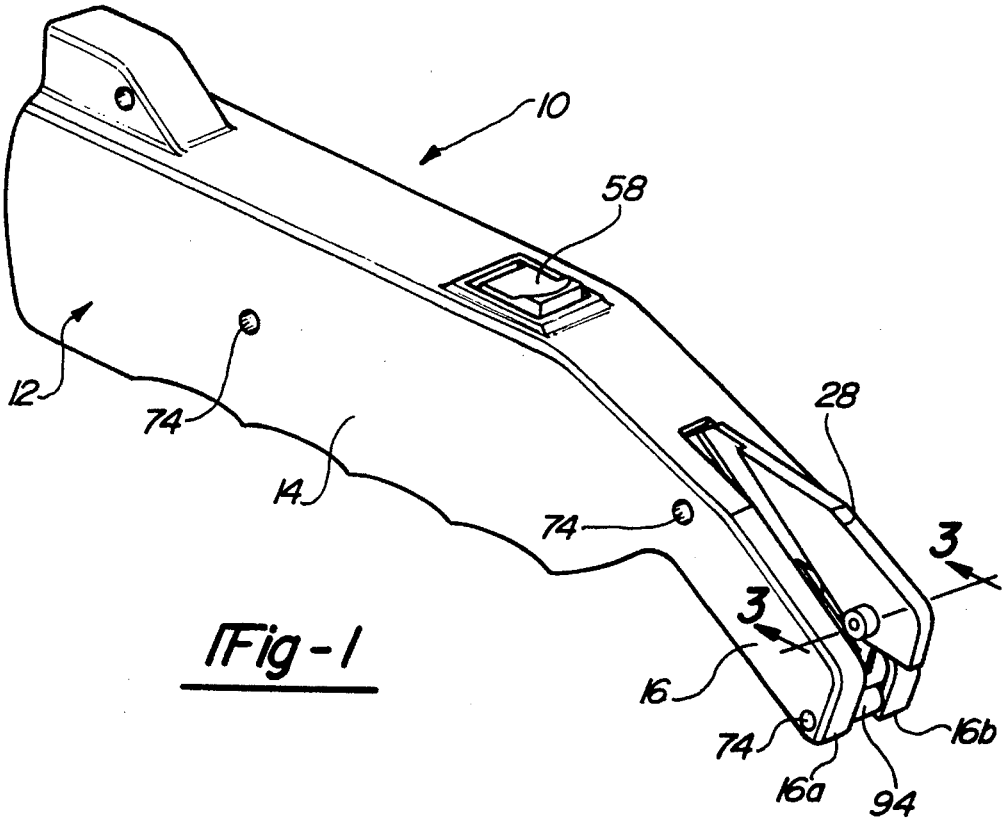
FIG. 1 is a side view of the exterior of an assembled preferred embodiment of the present invention.
Figure 2:
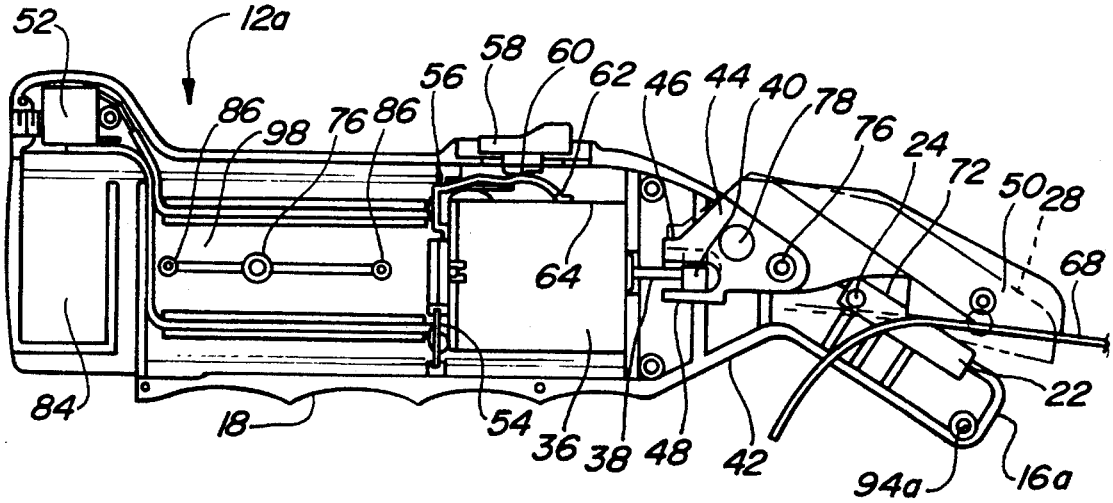
FIG. 2 is a longitudinal cross-sectional view of the preferred embodiment of the present invention shown in FIG. 1.

FIG. 1 shows a power cutting shear generally at 10 having a body 12. The body 12 is preferably formed of a light weight plastic material. In a preferred embodiment, the body 12 is assembled from two removably attached halves, one of which is shown in FIG. 2 generally as 12*a*. The opposing half (not shown) is substantially the mirror image of the half 12*a*. When the two halves are assembled, they are preferably snap fit together and fastened by a plurality of screws (not shown) received in a plurality of exterior apertures 74 to provide a substantially hollow body 12. Accordingly, the half 12*a* is shown with a plurality of interior apertures 76 associated with the exterior apertures 74, for receiving the screws when the halves are assembled. Snap-fitting engagement of the respective halves of the body 12 is achieved by providing a plurality of pins 86 which are received in a plurality of cooperating apertures (not shown) in the corresponding half of the body. It is clear that the hollow body can be formed and assembled in ways other than those described herein to provide a housing for the operative components of the device.

The body 12 further includes a handle portion 14 and a cutting end 16. The handle portion 14 has a grip 18 which permits the user to grasp the device and hold it in one hand. The cutting end 16 is bifurcated and has a finest pair of blades 20 and 22 mounted on each side 16*a* and 16*b* substantially parallel and spaced from one another. The spaced apart relationship between the sides 16*a* and 16*b* is achieved partially due to an end spacer 94 (shown clearly in FIGS. 1 and 3) disposed between the respective halves. A pin portion 94*a* of the spacer 94 is shown formed on the half 12*a*. The pin 94*a* is received in an aperture (not shown) which is supported on the opposing body half (also not shown). When the pin 94*a* is received in the aperture, the sides 16*a* and 16*b* remain fixed yet separated, thereby also separating the first pair of blades 20 and 22 supported on each of the respective sides 16*a* and 16*b*.

Figure 3:
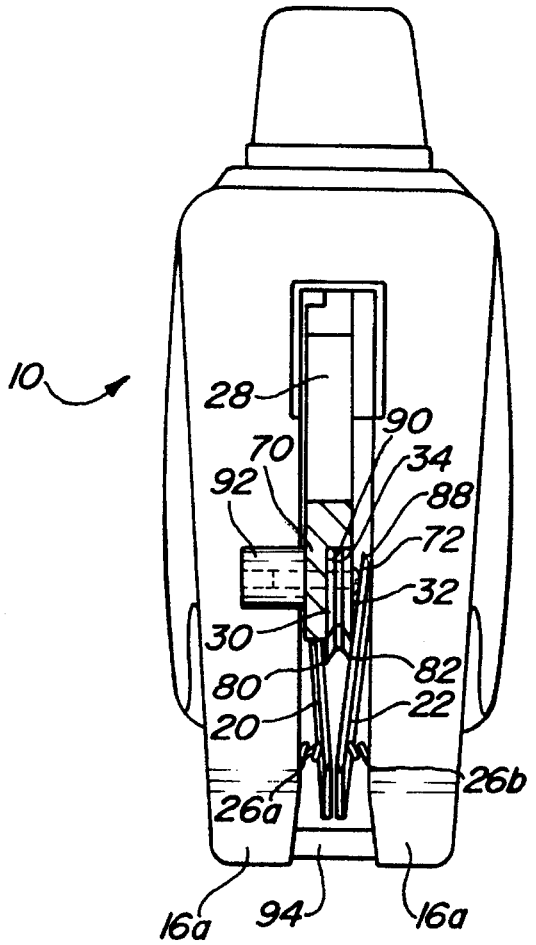
FIG. 3 is a partially exploded and disassembled front view of the preferred embodiment substantially along the line 3—3 of FIG. 1.

The blades 20 and 22 have a cutting edge 70 and 72. In the preferred embodiment, these are relatively small, flat straight-edged blades similar to razor blades. Each blade 20 and 22 is secured by a screw 24 at one end and by a spring 26*a* and 26*b* at the opposite end. The mounting arrangement for the blades 20 and 22 is best depicted in FIG. 3 which shows the front of the power cutting shear 10 in a partially disassembled and exploded view along the line 3—3 of FIG. 1. The springs 26*a* and 26*b* operate to bias the first pair of blades 20 and 22 together opposite their cutting edges 70 and 72 in such a way that cutting edges 70 and 72 contact with a second pair of blades 30 and 32 respectively having cutting edges 80 and 82 respectively.

The second pair of blades 30 and 32 are supported on a cutting arm 28 and are fastened together substantially parallel to one another and taken together have a width less than the distance separating the first pair of blades 20 and 22. The cutting arm 28 is pivotally mounted at its proximal end 44 to the body 12 as shown in FIG. 2. The distal end 50 of the arm 28 freely extends between the cutting sides 16*a* and 16*b* and supports the second pair of blades 30 and 32 thereon. As best shown in FIG. 3, a spacer 34 is mounted between blades 32 and 30. The cutting arm blades 30 and 32 are fastened on either side of the spacer 34 and the entire assembly is held together by a screw 88 which passes through the three members and is received in the cutting arm through an aperture 92. The assembly is supported on the cutting arm 28 at a recessed opening 90.

Figure 4:
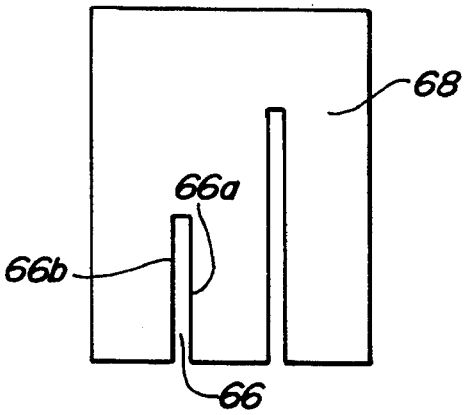
FIG. 4 is a plan view of a sheet of material cut by the cutting shears of the present invention.

As the cutting arm 28 pivots up and down bringing the cutting edges 70, 72, 80, 82 in contact with one another respectively, the cutting edges 80 and 82 cooperate with the first pair of cutting edges 70 and 72 to cut two substantially parallel and spaced slits out of a sheet of material thereby leaving a narrow elongated opening between the slits. The emerging opening 66 is shown in FIG. 4 with the strip removed from the sheet 68. Spacer 34 rides along the strip as it is severed from the material so that the strip does not interfere with the cutting action of the first and second pair of blades. In essence, the spacer 34 pushes the strip (not shown) between the slits 66*a* and 66*b* that are cut by the engagement of blades 30-20 and 32-22 so that the strip is continuously pushed inwardly between the cutting sides 16*a* and 16*b* so that it does not curl into the blades, which would ruin the pattern to be produced. This is illustrated in FIG. 2. Accordingly, the spacer 34 is made of a material having a dull edge which does not damage the emerging pattern.

The disclosed blade and spacer assembly permits the blades 70 and 72 to be easily removable and replaceable and further permits the spacer 34 to be replaced by one of larger width where a wider slit is to be removed from the sheet material.

As shown in FIG. 2, the cutting arm 28 is pivotally oscillated toward and away from the cutting end 16 by a motor 36. In the preferred embodiment, the motor is received centrally in one half of the body 12*a*. The motor 36 has a shaft 38 and a roller 40 eccentrically disposed thereon. The roller 40 communicates with the pivoting cutting arm 28 by being received in an arcuate channel 42 formed on the proximal end 44 of the cutting arm 28. As the shaft 38 and roller 40 rotate, the eccentric roller 40 alternately engages with an upper surface 46 of the arcuate channel 42 and a lower surface 48 of the arcuate channel 42 thereby pivoting the cutting arm 28 about its pivot point 78 so that the first pair of blades 20 and 22 operatively engage with the second pair of blades 30 and 32 to cut two parallel spaced apart slits.

In a preferred embodiment, the cutting shear 10 is powered by a pair of 1.5 volt batteries (not shown) which are received in a recessed compartment 98. The batteries are held in the recessed compartment 98 by an end cap (not shown) which is slidably received between the halves 12*a* and opposing half (not shown) at 84. The end cap 84 is further provided with a contact to provide electrical connection between the terminals of the battery and the motor 36. The end cap 84 is further slidably removable to provide access to the battery compartment 98 so that the batteries can be replaced when necessary. Accordingly, the exterior of the end cap 84 is ridged on its exterior surface to provide friction as the end cap 84 is slidably removed to expose the batteries. Alternatively, power can be supplied to the motor by an adapter (not shown) through a receptacle 52 which is operatively connected to positive and negative terminals 54 and 56 respectively of the motor 36. Also, according to the preferred embodiment, an on/off switch 58 is slidably received opposite the hand grip portion 18 of the body 12. The on/off switch 58 has a notch 60 which engages with a contact 62. As the switch 58 is moved forward, the contact engages with the side 64 of the motor 36 which is electrically connected to the power supply (be it battery or otherwise). Although the switch 58 is shown as opposite the hand grip 18, it is clear that it could be formed anywhere on the body 12 and could even be incorporated in the handle portion 14 as a trigger-type switch.

Figure 5:
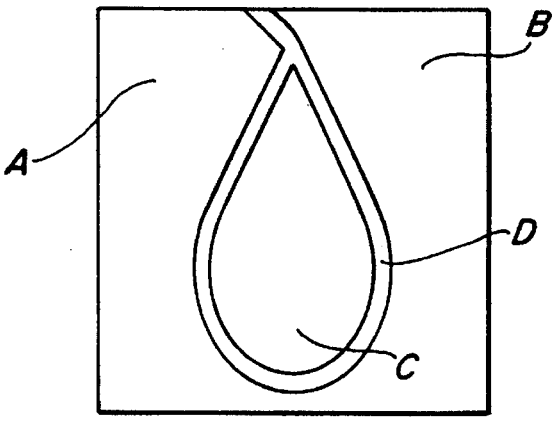
FIG. 5 is a plan view of a pattern cut by the cutting shears of the present invention.

In operation, the user holds the cutting shear 10 and inserts a piece of material 68 to be cut, paper for example, between the cutting arm 28 and the cutting end 16. The user advances the shear 10 along a pattern to be cut. As the upper blades 30 and 32 engage lower blades 20 and 22 respectively to cut a strip from the material 68 spacer 34 drives the strip inwardly and out of the way of the blades. In a stained glass application, the shears 10 are advanced along the edge separating various parts of the artwork. For example, FIG. 5 represents a shape that could be made with a stained glass pattern having a first subpiece A, a second subpiece B and a third subpiece C which can be assembled to make a whole piece of glass. The cutting shears of the present invention would be used to cut out a pattern for the subpieces A, B. C, while taking into account that area D would be the area which would be filled in with soldering when the subpieces A, B, C are assembled. Thus, arrangement of the blades 30 and 32 is preferably such to produce openings in a sheet material having a width of 0.063 and 0.031 inches, although any width opening can be produced simply by increasing the distance between the second pair of blades 30 and 32.

Having thus described my invention, other additional embodiments will become apparent to those skilled in the art to which it pertains without deviating from the scope of the appended claims.

I claim the following:

1. A power cutting shear of the type adapted to cut a narrow, elongated strip from sheet material, comprising:

an elongated body having a cutting end comprised of a first side spaced laterally apart from and opposite to a second side;

a first pair of flat blades each blade having an elongated cutting edge, one of said first pair of blades being supported on each side of said cutting end with their cutting edges substantially parallel to and spaced apart from one another and aligned substantially longitudinally on said body;

an elongated arm pivotally mounted adjacent said cutting end of said body;

a second pair of flat blades each of said blades having an elongated cutting edge, said second pair of blades being supported on said elongated arm with their cutting edges substantially parallel to one another and aligned substantially longitudinally on the arm, said second pair of blades being spaced from one another at a distance less than the distance that said first pair of blades are separated from one another;

a motor supported on said body and operatively connected to said elongated arm for pivotally oscillating said arm toward and away from said cutting end so that each one of said second pair of blades operatively engages with a respective one of said first pair of blades to cut a pair of substantially parallel slits in the sheet material to produce an elongated strip from said sheet material; and a power supply operatively connected to said motor.

2. The power cutting shear as set forth in claim 1, further comprising means for continuously displacing the strip cut from said sheet material as said first and second pair of blades operatively engage with one another to cut a strip from said sheet material.

3. The power cutting shear as set forth in claim 1, wherein said first and second pair of blades are removably attached to said cutting end and arm respectively.

4. The power cutting shear as set forth in claim 1, further comprising means for biasing said first pair of blades against said second pair of blades as said second pair of blades operatively oscillate therebetween.

5. The power cutting shear as set forth in claim 1, wherein said motor operatively connected with said arm further includes an eccentric rotating means for engaging with a portion of said arm to pivotally oscillate said arm to and away from said cutting end.

6. The power cutting shear as set forth in claim 1, wherein said body further comprises a handle portion opposite said cutting end.

7. The power cutting shear as set forth in claim 1, wherein said body further comprises an on/off switch operatively connected between said motor and said power supply, said on/off switch being adapted to be selectively engaged by a user to apply power to said motor.

* * * * *